US005729975A

United States Patent [19]

Bekkering

[11] Patent Number: 5,729,975

[45] Date of Patent: Mar. 24, 1998

[54] SEMI-AIRGAP MANIFOLD FORMATION

[75] Inventor: Mark W. Bekkering, Byron Center, Mich.

[73] Assignee: Benteler Automotive Corporation, Grand Rapids, Mich.

[21] Appl. No.: 661,603

[22] Filed: Jun. 11, 1996

[51] Int. Cl.[6] ..... F01N 7/10

[52] U.S. Cl. ..... 60/323

[58] Field of Search ..... 60/323, 322

[56] References Cited

U.S. PATENT DOCUMENTS

| | | | |
|---|---|---|---|
| 4,142,366 | 3/1979 | Tanahashi | 60/322 |
| 4,373,331 | 2/1983 | Santiago et al. | 60/323 |
| 4,386,586 | 6/1983 | Santiago et al. | 60/323 |
| 4,689,952 | 9/1987 | Arthur | 60/323 |
| 5,148,675 | 9/1992 | Inman | 60/323 |
| 5,349,817 | 9/1994 | Bekkering | 60/322 |

FOREIGN PATENT DOCUMENTS

| | | |
|---|---|---|
| 3216980 | 11/1983 | Germany . |
| 3714761 | 11/1988 | Germany . |
| 1432293 | 4/1976 | United Kingdom . |

*Primary Examiner*—Marguerite McMahon
*Attorney, Agent, or Firm*—Price, Heneveld, Cooper, DeWitt and Litton

[57] ABSTRACT

An engine exhaust manifold and method of making it, comprising an exhaust port flange having a plurality of exhaust port openings therethrough, a base half shell having a pair of elongated, spaced walls terminating in elongated free ends, a plurality of runners attached to the port flange at the exhaust port openings, a liner half shell having a wall thickness less than that of the base half shell, having a pair of spaced walls terminating in elongated free ends overlapping the base half shell free ends, the liner half shell being oriented opposite the orientation of the base half shell to form a flow passage therebetween, a jacket half shell having a thickness greater than that of the liner half shell, having a pair of spaced elongated walls terminating in elongated free ends, the jacket half shell extending over and encompassing the liner half shell but spaced therefrom to form an airgap therebetween except at the jacket half shell free ends and the liner half shell free ends, the jacket half shell free ends overlapping both the liner half shell free ends and the base half shell free ends, and engaging the liner half shell free ends, the base half shell free ends, liner half shell free ends, and jacket half shell free ends being welded together to form a manifold body, and an outlet port from the manifold flow passage, the liner free ends extending beyond the jacket free ends to provide sacrificial welding portions during welding assembly.

11 Claims, 2 Drawing Sheets

SEMI-AIRGAP MANIFOLD FORMATION

BACKGROUND OF THE INVENTION

This invention relates to engine exhaust manifold assemblies.

Exhaust manifolds are formed of what is commonly called a "log" which forms the common gas flow chamber, a plurality of runners which form the individual flow passages from the engine cylinders to the log, and an outlet orifice to the downstream exhaust system which typically includes a catalytic converter. In recent years, manifolds have been formed more and more of light weight metal such as stainless steel rather than the prior heavy castings that were the standard structure. More recently, dual wall, airgap manifolds have been devised in order to allow quick internal temperature rise of a liner, i.e. inner wall inside a manifold jacket, i.e. outer wall, for quick activation of the downstream catalytic converter. The quicker the catalytic converter activation, the less the atmospheric pollution. Airgap manifolds have an inner tubular liner which is relatively thin in dimension, and an outer tubular jacket generally spaced from the liner and having a thickness greater than that of the liner. These two elements define the airgap between them. Although the thin liner enables rapid temperature rise of the liner and the downstream catalytic converter, the jacket stays relatively cool because it is thermally insulated from the liner by the airgap. Typically, the liner and jacket are formed of a clam shell type of arrangement, two connected clam shells forming the liner and two connected clam shells forming the jacket. The two half shells for the liner are typically secured together along their longitudinal edges by welding. The larger jacket half shells are likewise secured together along their longitudinal edges by welding. The plurality of runners are attached to the resulting log.

In U.S. Pat. No. 5,349,817 assigned to the assignee herein, is set forth a novel connection of the runners to the port flange. The port flange is an elongated plate which attaches the manifold assembly to the engine itself by bolts. It has several ports which communicate with the namers. Although the airgap type arrangement is particularly beneficial for rapid heat up of the catalytic converter, the outlet runners which are welded to the log and to the port flange, normally are separate tubular elements causing the manifold to require a space of considerable width to fit between the engine and the adjacent parts of the vehicle. In some modern engine assemblies, there is considerably less space or clearance between the engine and adjacent vehicle components to receive the exhaust manifold. Therefore, although the dual wall assembly is particularly advantageous, the present dual wall constructions do not readily fit into this limited space. The small space allowance necessitated conception of a new design that would still retain an advantageous dual wall feature for minimal heat up time.

SUMMARY OF THE INVENTION

An object of this invention is to provide a novel engine exhaust manifold structure capable of fitting within a relatively narrow space adjacent the vehicle engine, and yet have dual wall features capable of rapid heat up to an elevated temperature so as to have rapid warm up and activation of the downstream catalytic converter. The present invention provides an exhaust manifold structure that achieves these objectives, and a method of forming an exhaust manifold structure that achieves these objectives. The components of the novel assembly can be formed by stamping techniques, and then are specially assembled together. These components constitute three half shells, namely, a base half shell, and liner half shell and a jacket half shell. An extended portion of the liner half shell acts as sacrificial material to weldingly lock the liner half shell in place between the base half shell and an overlapping jacket half shell. The base half shell has integral extruded runners. These integral runners protrude into the ports of the port flange and are welded to the port flange.

The novel manifold combines an exhaust port flange with bolt receiving openings and a plurality of port openings therethrough; an elongated base half shell having a pair of elongated, spaced, parallel walls terminating in elongated free ends and an elongated juncture wall integral with and joining said pair of spaced walls, the juncture wall having a plurality of outwardly protruding, integral extruded runners, the outer ends of which are attached to the port flange at the noted exhaust port openings; an elongated liner half shell having a thickness less than that of the base half shell, and having a pair of spaced, elongated parallel walls terminating in elongated free ends and overlapping the base half shell free ends; an elongated jacket half shell having a thickness greater than that of the liner half shell, having a pair of spaced, elongated, parallel walls terminating in elongated free ends; the jacket half shell extending over and encompassing the liner half shell but spaced therefrom to form an airgap therebetween except at the jacket half shell free ends and the liner half shell free ends. The jacket half shell free ends overlap both the liner free ends and the base half shell free ends and is welded thereto to form the manifold. The manifold has an outlet port.

The novel method connecting these components together comprises extending the liner half shell free ends over the base half shell free ends, while oriented opposite thereto, extending the jacket half shell free ends over the liner half shell free ends, oriented in the same direction, but with the liner half shell free ends protruding slightly further than the jacket half shell free ends, and welding the three together, using the extended portions of the liner half shell free ends as sacrificial welding material.

These and other objects, advantages, and features of the invention will become apparent upon studying the following specification in conjunction with the drawings.

DESCRIPTION OF THE PREFERRED EMBODIMENT

Figure 1:
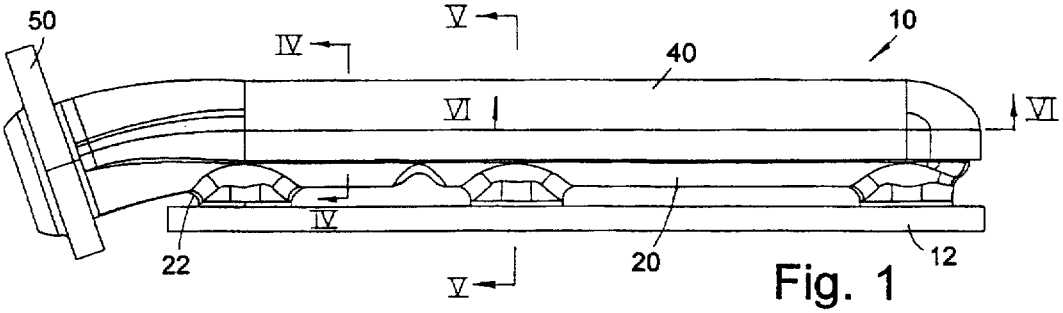
FIG. 1 is an elevational view of the novel manifold.

Referring now to the drawings, the complete manifold assembly 10 is formed from several primary components including a port flange 12, a base half shell member 20 which may also be designated herein as a runner half shell and which has integral runners 22, an interior liner half shell 30 (FIG. 4) and a jacket half shell 40, as well as an annular clamp flange 50 or the equivalent at the manifold outlet 60.

Figure 2:
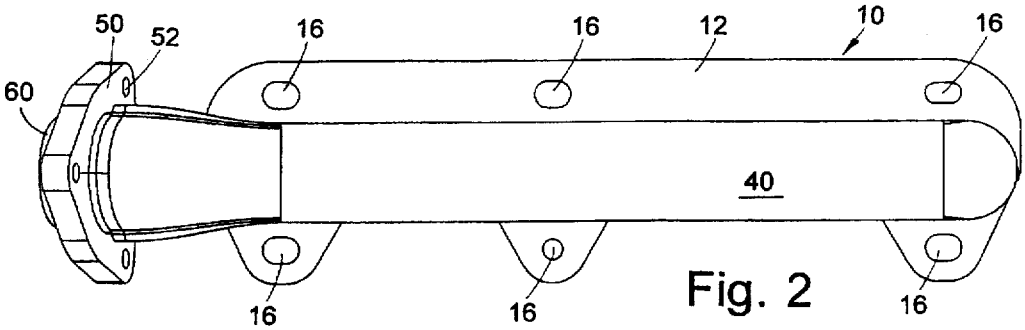
FIG. 2 is plan view of the novel manifold.
Figure 3:
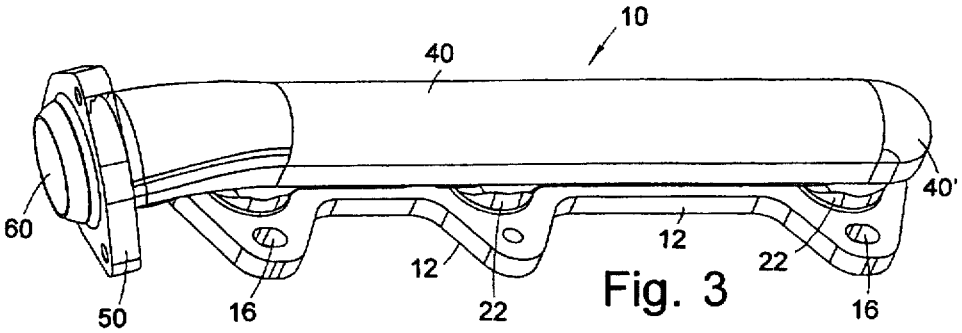
FIG. 3 is an isometric view of the novel manifold.
Figure 6:
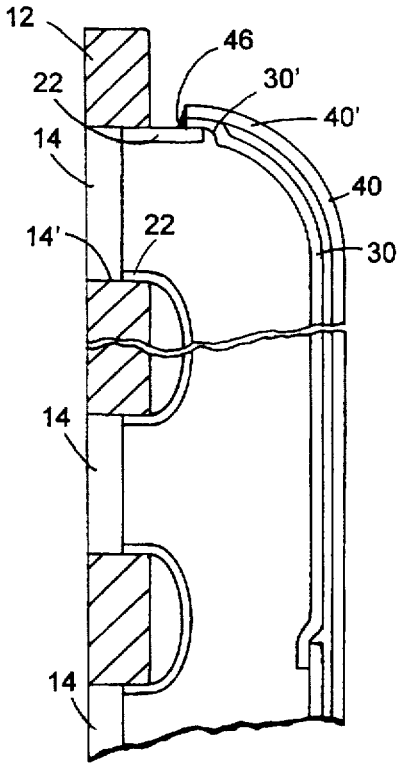
FIG. 6 is a longitudinal sectional fragmentary view taken on plane VI—VI of FIG. 1.
Figure 8:
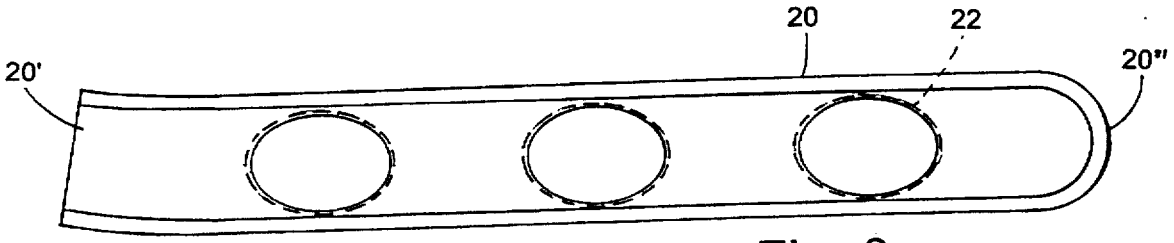
FIG. 8 is a plan view of the base half shell of the assembly.
Figure 7:
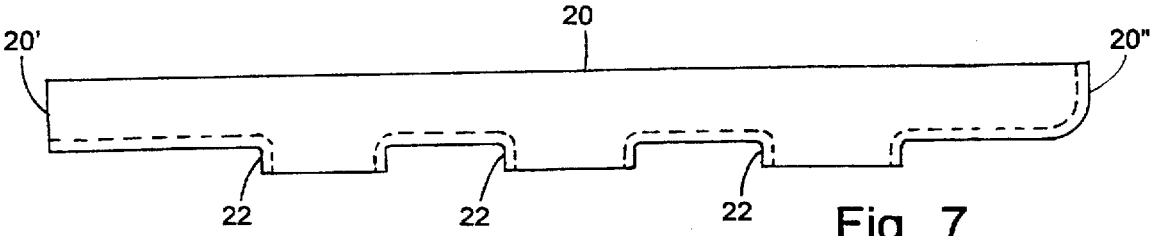
FIG. 7 is an elevational view of the base half shell.

The elongated, planar exhaust port flange 12 has a plurality, here three, of spaced exhaust port orifices 14 therethrough (FIG. 6). The exhaust port flange also has a plurality of bolt receiving openings 16 (FIG. 2) over its length, preferably on opposite sides of each exhaust port orifice 14, for effective tight clamping of the manifold to the engine (not shown).

Each exhaust port orifice 14 has an inner surface wall 14' of generally cylindrical configuration i.e. circular or oval in cross section. The tubular runners of the manifold body are secured in place to walls 14' as explained more fully hereinafter.

The manifold body or log is basically formed of the three components previously named, i.e. the base half shell, the liner half shell and the jacket half shell. These three components are interconnected with each other in a particular fashion. All three of these components may be individually formed by stamping techniques. They are preferably of stainless steel.

Base half shell 20 is an elongated, stamped, metal element, preferably a stainless steel element, and most preferably 304 stainless steel, about 1.8 mm thick. It is formed into a generally semi-cylindrical configuration open at one end 20' and closed at the opposite end 20". Formed integrally with and from this base half shell are the protruding runners 22. Runners 22 have a somewhat tapered shape ending in a generally cylindrical configuration, at the outer end portions thereof, circular or oval in cross section, and defining flow passages for exhaust gases. These runners are integrally formed into base half shell 20 as by first piercing the half shell at the desired locations of the runners, and then extruding the runners from the base half shell by a stamping die. The shape of the outer ends of protruding runners 22 matches that of port orifices 14, but the diameter of runners 22 is slightly smaller than the diameter of peripheral wall 14' of port orifices 14 in the port flange 12 so as to fit into these port orifices. The longitudinal spacing of integral runners 22 is caused to be identical to the spacing of port orifices 14, so as to coincide longitudinal with and fit into these orifices. These runners, and thus the base half shell is secured to port flange 12 by welding the inner ends of runners 22 to the port walls of the port flange. The base half shell 20 has a pair of elongated, spaced walls 20A (FIG. 4) terminating in elongated 20 free ends which are generally parallel to each other. An elongated juncture wall 20B is integral with and joins the pair of spaced walls 20A. The runners 22 extend from the convex side of the base half shell. The open side of the base half shell is oriented in the opposite direction as the runners, i.e. away from the port flange.

Interfitting with base half shell 20 are the liner half shell 30 and jacket half shell 40. The liner half shell 30 has a generally elongated semi-cylindrical configuration. It is oriented opposite to that of the base half shell, i.e. with its open side and cavity toward the base half shell open side and cavity. It has a thickness less than that of the base half shell, preferably being about 0.7 mm thickness of 321 stainless steel. It has a pair of elongated, spaced walls 30A terminating in elongated, generally parallel free ends, and spaced from each other an mount slightly greater than the spacing of legs 20A from each other, to overlap the base half shell free ends in the manner depicted for example in FIG. 4, and leave a slight clearance. This clearance is preferably about one-half mm. The overlap is preferably about 4 to 6 mm. The slight clearance is provided between the free ends of the base half shell and the free ends of the liner half shell for ease of production assembly, accounting for tolerance variations for example. Extending over and encompassing the liner half shell in the same orientation is the jacket half shell 40. This jacket half shell comprises an elongated, stamped component, preferably of 304 stainless steel about 1.8 mm thick, i.e. having a wall thickness greater than that of the liner half shell. It includes a pair of spaced elongated walls 40A terminating in generally parallel elongated free ends. The jacket half shell is spaced from the liner half shell over their length to form an airgap 36 of about 2–4 mm therebetween, except at the jacket half shell free ends which engage the liner half shell free ends, and overlap both the liner half shell free ends and the base half shell free ends. Therefore, the spacing of the jacket half shell free ends from each other is slightly greater than the spacing of the liner free ends from each other.

Figure 4:
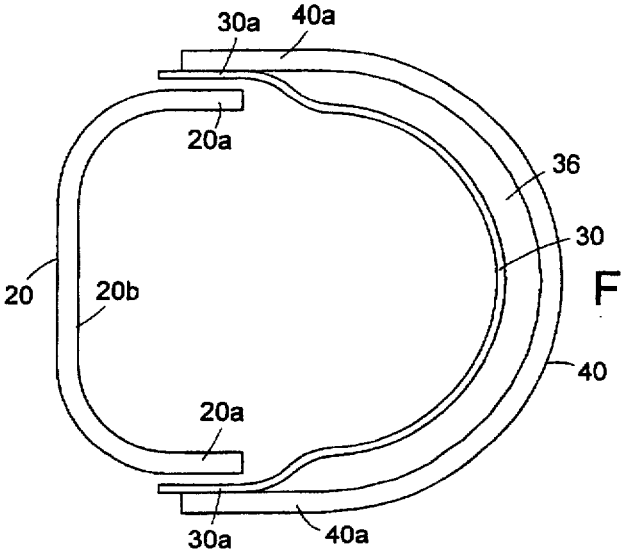
FIG. 4 is an enlarged sectional view of the novel manifold taken between the port flange ports, on plane IV—IV of FIG. 1.
Figure 5:
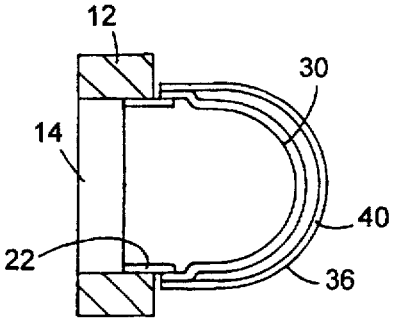
FIG. 5 is a sectional view of the manifold taken through one of the port flange ports on plane V—V of FIG. 1.

When these three components are placed in overlapping condition during production assembly thereof, the liner free ends are caused to protrude beyond the jacket free ends a small amount e.g. about 1 mm extension as shown in FIG. 4. During the subsequent welding e.g. MIG welding of these three components together (FIG. 6) at free ends 46, the liner extensions are sacrificed by being fused with the weld material to assure an effective seal and securement of the liner half shell sandwiched between the jacket half shell and the base half shell. The resulting assembly is solid, preventing rattling. One end 20" of the base half shell is closed while the other end 20' is open. One end 30' (FIG. 6) of liner half shell 30 is also closed while the other end is open. Similarly, one end 40' of the jacket half shell 40 is closed (FIG. 6) while the opposite end is open. When the three half shell components are joined together, the three open ends are together to form and surround an exhaust outlet 60. The three closed ends are also together to close off this end of the log. Exhaust outlet 60 is shown to have a conventional annular clamp flange 50 or the equivalent around the outlet for connection to the adjoining downstream exhaust conduit as by bolts through bolt holes 52.

The resulting assembly is of relatively small width so as to readily fit in a narrow space between an engine and the adjacent vehicle components. Because the port flange 12 stays at a relatively low operating temperature, the use of a single wall for the extruded runners 22 has been found to be effective. As exhaust gases are ejected from the engine through runners 22 and into the log, they strike the thin liner half shell 30 which is transverse to the flow, rapidly heating it to a high temperature due to its low thermal mass for minimum heat up time of it and the downstream catalytic converter. The airgap 36 between liner half shell 30 and jacket half shell 40 insulates the liner so as to retain its high temperature and the relatively low temperature of the jacket half shell.

The resulting structure performs better than a conventional heat shield which is simply an added element outside of a thick single wall manifold. In contrast to a heat shield arrangement, the present manifold assembly has rigidity due to the parts being bonded all along their length. Moreover it is functionally superior because the thin inner liner half shell readily achieves elevated temperature for optimum performance of the downstream catalytic converter. The manifold is simple to produce and assemble, has less components than the previously known double wall units, and yet is effective in operation.

Conceivably, minor variations may be made in this structure to suit a particular engine configuration environment. Hence, and/or the invention is not intended to be limited to the preferred embodiment set forth as exemplary of the invention, but only by the scope of appended claims and the equivalents thereto.

The embodiments of the invention in which an exclusive property or privilege is claimed are defined as follows:

1. An engine exhaust manifold comprising:

an exhaust port flange having a plurality of exhaust port openings therethrough;

a base half shell having a pair of elongated, spaced walls terminating in elongated free ends;

said base half shell having a plurality of runners attached to said port flange at said exhaust port openings;

a liner half shell having a wall thickness less than that of said base half shell, having a pair of spaced walls terminating in elongated free ends overlapping said base half shell free ends; said liner half shell being oriented opposite the orientation of said base half shell to form a flow passage therebetween;

a jacket half shell having a thickness greater than that of said liner half shell, having a pair of spaced elongated walls terminating in elongated free ends, said jacket half shell extending over and encompassing said liner half shell but spaced therefrom to form an airgap therebetween except at said jacket half shell free ends and said liner half shell free ends, said jacket half shell free ends overlapping both said liner half shell free ends and said base half shell free ends, and engaging said liner half shell free ends;

said base half shell free ends, said liner half shell free ends, and said jacket half shell free ends being welded together to form a manifold body; and said manifold having an outlet port from said flow passage.

2. The engine exhaust manifold in claim 1 wherein said runners project into said exhaust port openings and are welded to said exhaust port flange.

3. The engine exhaust manifold in claim 1 wherein said base half shell, liner half shell and jacket half shell are of stamped stainless steel.

4. The engine exhaust manifold in claim 3 wherein said liner half shell has a wall thickness of about 0.7 mm and said base half shell and jacket half shell have a wall thickness of about 1.8 mm.

5. The claim 1 herein said runners are integral extrusions from said base half shell.

6. The engine exhaust manifold in claim 2 wherein said port flange has a plurality of bolt orifices therethrough.

7. The engine exhaust manifold in claim 1 wherein said jacket half shell is oriented the same as said liner half shell.

8. An engine exhaust manifold comprising:

an exhaust port flange having a plurality of exhaust port openings therethrough;

a base half shell having a pair of elongated, spaced, elongated walls terminating in elongated, generally parallel free ends, and an elongated juncture wall integral with and joining said pair of spaced walls;

said juncture wall having a plurality of outwardly protruding, integral, extruded runners attached to said port flange at said exhaust port openings;

a liner half shell having a wall thickness less than that of said base half shell, having a pair of spaced walls terminating in elongated, generally parallel free ends, and overlapping said base half shell free ends; said liner half shell being oriented opposite the orientation of said base half shell to form a flow passage therebetween;

a jacket half shell having a thickness greater than that of said liner half shell, having a pair of spaced parallel elongated walls terminating in elongated free ends, said jacket half shell extending over and encompassing said liner half shell but spaced therefrom to form an airgap therebetween except at said jacket half shell free ends and said liner half shell free ends, said jacket half shell free ends overlapping both said liner half shell free ends and said base half shell free ends, and engaging said liner half shell free ends;

said base half shell free ends, said liner half shell free ends, and said jacket half shell free ends being weldably joined together to form a manifold body with said liner half shell free ends having sacrificed portions within the weld joint; and said manifold having an outlet port from said flow passage.

9. A method of making an engine exhaust manifold comprising the steps of:

providing an exhaust port flange having a plurality of exhaust port openings therethrough;

providing a base half shell having a pair of elongated, spaced walls terminating in free ends and an elongated juncture wall integral with and joining said pair of spaced walls;

extruding from said juncture wall a plurality of outwardly protruding integral tubular runners;

attaching said runners to said port flange at said exhaust port openings;

providing a liner half shell having a thickness less than that of said base half shell, and having a pair of spaced walls terminating in free ends;

providing a jacket half shell having a thickness greater than that of said liner half shell, and having a pair of spaced walls terminating in free ends;

causing said jacket half shell to extend over and encompass said liner half shell but spaced therefrom to form an airgap therebetween except at said jacket half shell free ends and said liner half shell free ends;

causing said jacket half shell free ends to overlap and engage said liner half shell free ends and causing both said liner half shell free ends and said jacket half shell free ends to overlap said base half shell free ends;

welding said base half shell free ends, said liner half shell free ends, and said jacket half shell free ends together to form the manifold; and providing an outlet port from said manifold.

10. The method in claim 9 including the steps of causing said liner half shell free ends to overlap said base half shell free ends more than said jacket half shell free ends overlap said base half shell free ends, such that, prior to said welding step, said liner half shell free ends have portions that protrude beyond said jacket half shell free ends; and during said welding step sacrificing said protruding portions into the resulting weld.

11. The method in claim 10 wherein said liner half shell is oriented opposite to said base half shell, and said jacket half shell is oriented the same as said liner half shell.

* * * * *

UNITED STATES PATENT AND TRADEMARK OFFICE

CERTIFICATE OF CORRECTION

PATENT NO. : 5,729,975
DATED : March 24, 1998
INVENTOR(S) : Mark W. Bekkering

It is certified that error appears in the above-identified patent and that said Letters Patent is hereby corrected as shown below:

Column 1, line 38;
"namers" should be --runners--;

Column 3, line 61;
"mount" should be --amount--;

Column 5, claim 5, line 45;
After "The" insert --engine exhaust manifold in--;

Column 5, claim 5, line 45;
"herein" should be --wherein--;

Column 5, claim 7, line 49;
After "wherein said" insert --liner half shell is oriented opposite to said base half shell to form a flow passage therebetween and said--.

Signed and Sealed this

Twenty-fourth Day of November, 1998

Bruce Lehman

*Attest:*

BRUCE LEHMAN

*Attesting Officer*

*Commissioner of Patents and Trademarks*